United States Patent [19]

Eisen et al.

[11] Patent Number: 4,704,042

[45] Date of Patent: Nov. 3, 1987

[54] REGISTER AND PAGE THEREFOR

[76] Inventors: Steven P. Eisen, 1463 N. Grove Ave., Upland, Calif. 91786; Richard L. Holden, 1744 Grasscreek Dr., San Dimas, Calif. 91773

[21] Appl. No.: 857,737

[22] Filed: Apr. 29, 1986

[51] Int. Cl.[4] ..... B42F 13/00; B42D 1/00; B65D 85/30; B65D 65/02

[52] U.S. Cl. ..... 402/79; 281/38; 206/312; 150/52 B; 40/159; 40/405

[58] Field of Search ..... 402/54, 64, 66, 63, 402/79; 40/405, 159, 537; 282/86, 10, 9 A, 29 A; 281/38; 150/52 B, 133, 147, 149, 151, 152; 206/311, 312, 450

[56] References Cited

U.S. PATENT DOCUMENTS

| | | | |
|---|---|---|---|
| 1,168,634 | 1/1916 | Hoffman . | |
| 1,443,092 | 1/1923 | Pettis | 402/79 |
| 1,557,170 | 10/1925 | Kaufmann | 402/79 |
| 2,421,503 | 6/1947 | Hermon . | |
| 2,531,606 | 11/1950 | Broughton | 150/147 |
| 2,869,604 | 1/1959 | Fitzsimmons . | |
| 3,025,778 | 3/1962 | Stuckens . | |
| 3,351,064 | 11/1967 | Cohn . | |
| 3,459,361 | 8/1969 | Matton . | |
| 3,555,713 | 1/1971 | Leinbach | 40/405 |
| 3,620,553 | 11/1971 | Donovan | 402/79 |
| 3,721,173 | 3/1973 | Jaffe . | |
| 3,797,146 | 3/1974 | Holes | 402/79 |
| 4,043,477 | 8/1977 | Deese | 402/79 |
| 4,065,864 | 1/1978 | Stanley . | |
| 4,356,649 | 11/1982 | Diamond et al. . | |
| 4,447,973 | 5/1984 | Wihlke | 40/537 |

OTHER PUBLICATIONS

"Personal Inventory Register", advertisement, p. 24 of 20th Century Plastics Catalog (1984).

20th Century Plastics catalog, pp. 1–44 (1985).

Samples of title page, inventory log page, and photographic page of "At-a-Glance Household Inventory Record", Shaeffer Eaton (1980).

Sample page of Photographic Album, Melannco Int'l Ltd.

*Primary Examiner*—E. R. Kazenske

*Assistant Examiner*—Paul M. Heyrana, Sr.

*Attorney, Agent, or Firm*—David Weiss

[57] ABSTRACT

A register for maintaining documentation and a description of such documentation, particularly for maintaining photographs of items of property along with a description of the items included in the photographs. The register includes a loose-leaf binder, with a loose-leaf page having one section for containing an inventory record which is hinged to a second section for containing photographs. The inventory section is normally folded upon and facing the photographic section, with the inventory record facing the photographs. An edge of the photographic section perpendicular to the hinge is retained by the loose-leaf binder, and the inventory section is configured with respect to the photographic section such that when the folded page is retained by the binder the inventory section may be unfolded away from the photographic section along the hinge.

33 Claims, 6 Drawing Figures

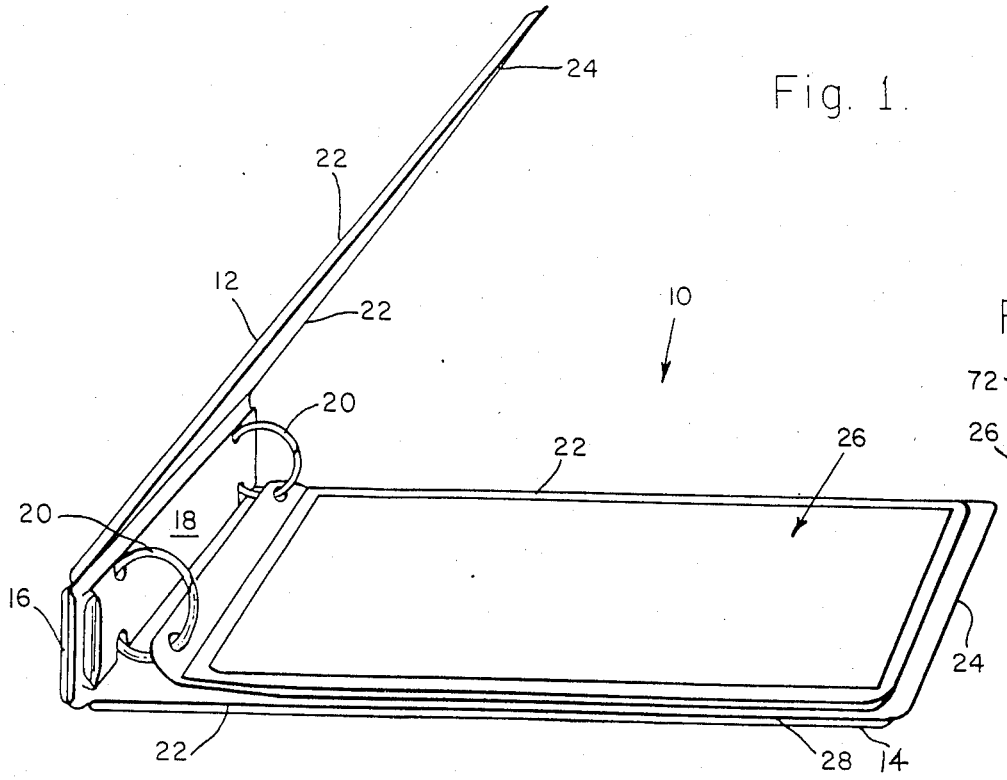
Fig. 1.
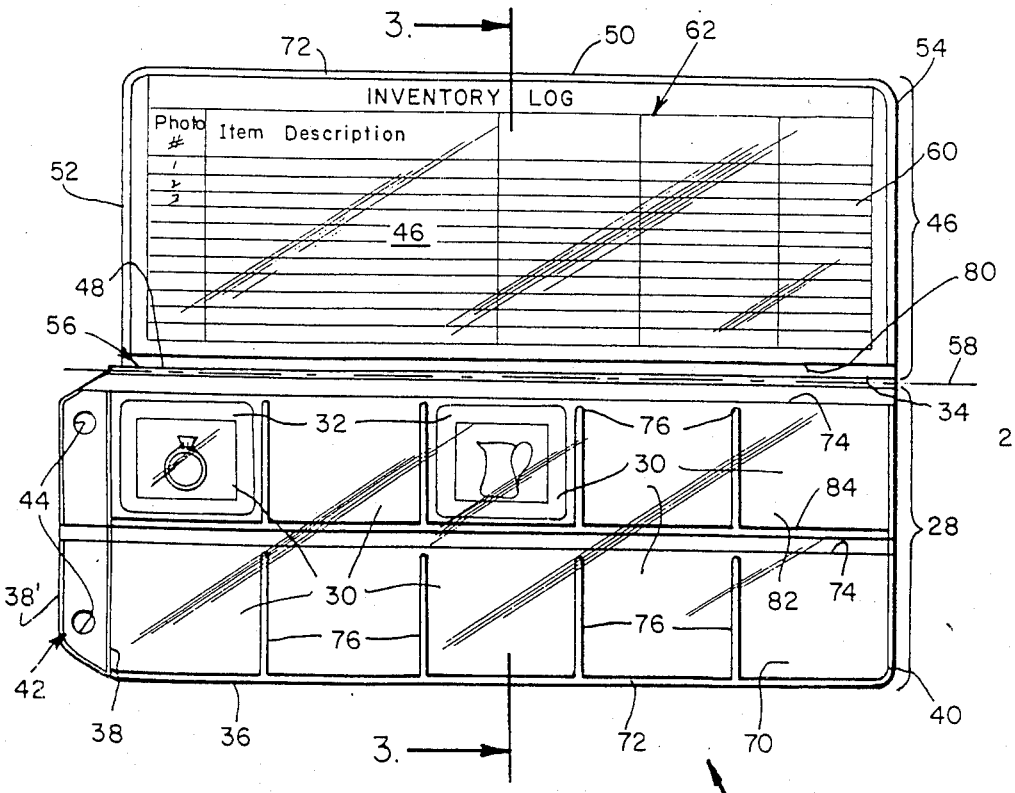
Fig. 2.
Fig. 3.
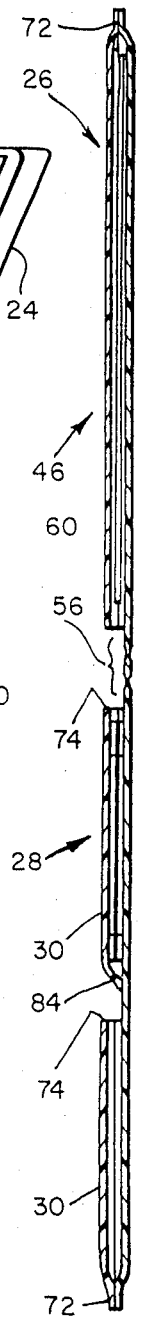

Fig. 4.
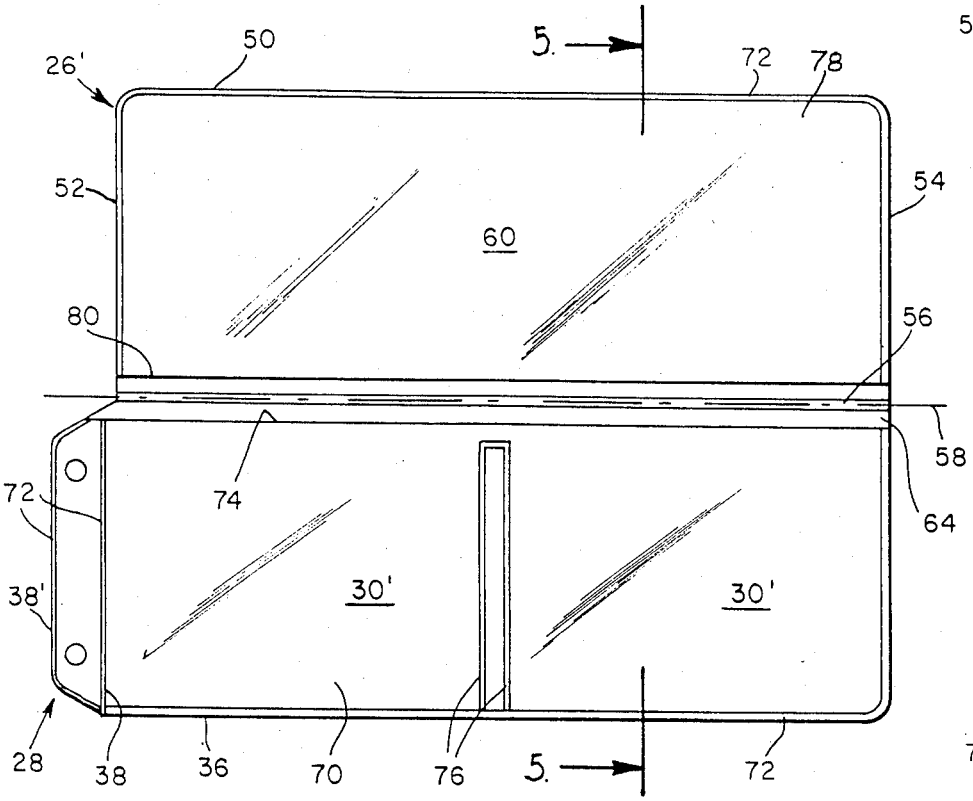
Fig. 5.
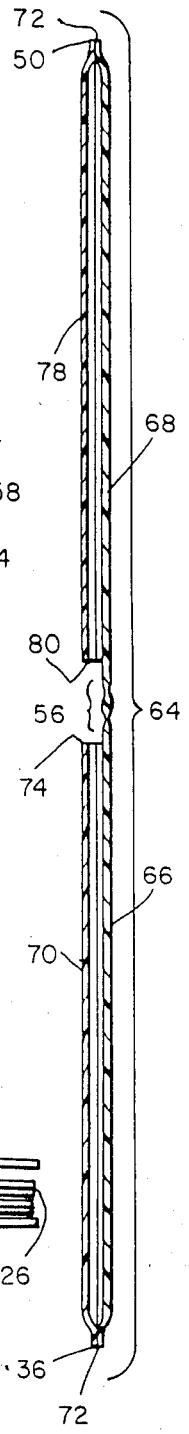
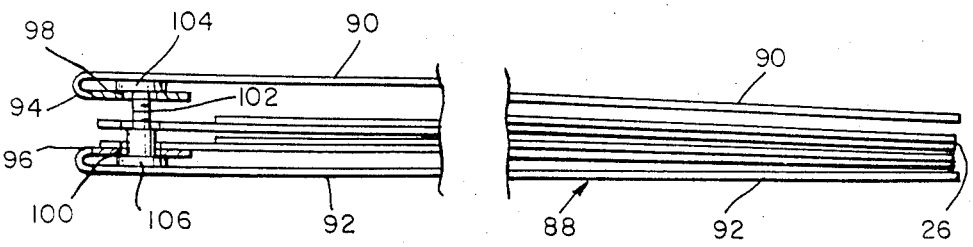
Fig. 6.

REGISTER AND PAGE THEREFOR

BACKGROUND OF THE INVENTION

This invention relates to inventory documentation systems, and more particularly to a register including pages for maintaining in organized fashion photographic documentation of property.

In certain circumstances it may become necessary to prove the existence and value of property. For example, in the event of destruction of or damage to insured property, the insurer may request evidence of the existence and condition prior to destruction of valuable items of personal property or special improvements to real property. The same is true in the event of lost or stolen items, and in addition a reliable description of the item would assist law enforcement authorities in its recovery.

One system for documenting property, for these and other purposes, involves assembling photographs of the property in a loose-leaf binder. Each photograph may be inserted in a pocket of a loose-leaf page of flexible transparent material such as vinyl. Elsewhere on the page may be another pocket for receiving an index or inventory record of the items in the photograph, identifying the items and perhaps recording selected information concerning the items in the photograph. Alternatively, the inventory may be recorded on a separate page facing the page containing the photographs.

This type of system is particularly well suited for compiling a register of household property. When completed, the household register should be stored in a secure location outside the home in order to assure against its destruction in the event of fire or other catastrophic occurrence to the home. A convenient storage location for such a register is a bank safety deposit box.

SUMMARY OF THE INVENTION

In accordance with the present invention, an improved inventory register is provided having a configuration for being accommodated within a bank safety deposit box of a small standard size. The novel loose-leaf page of the register includes an inventory record or index section or panel which is hinged to a photographic section or panel. The inventory panel is normally folded upon and facing the photographic panel, with the inventory record facing the photographs when contained in their respective pockets, and the photographic panel is adapted for being retained by the loose-leaf binder. When so retained, the entire page and hence the inventory record and the photographs may be viewed by unfolding the inventory section away from the photographic section along the hinge.

The dimensions of the binder and the folded pages are such that the register may fit within a standard small size safety deposit box. The binder and the folded pages are rectangular, and have a long dimension and a short dimension generally conforming to the interior of a small standard safety deposit box. The hinge of the page, along which the inventory panel may be folded toward and unfolded away from the photographic panel, is situated along the long dimension of the folded page.

Briefly described, the register page of the present invention includes a first flexible panel having at least one transparent pocket for receiving photographs or other documents, and having means along an edge thereof for cooperating with page retaining means of a binder for being retained in the binder. The page further includes a second flexible panel having a transparent pocket for receiving a description of the photographs or other documents received by the pockets of the first panel. The second panel is hingedly attached to the first panel along an edge of each of the panels, the edge of the first panel along which the second panel is hingedly attached being adjacent the edge of the first panel along which is situated the means for cooperating with the binder's page retaining means. The configuration of the second panel with respect to the first panel is such that the second panel may be folded upon and unfolded away from the first panel without the second panel's engaging the binder's page retaining means when the page is being retained by the binder.

The page may be manufactured from a first flexible transparent sheet folded along a fold line parallel to an edge of the first sheet to form a first portion and a second portion hinged to one another along the fold line. A second flexible transparent sheet is superposed on the first portion and joined to the first sheet to form at least one pocket with the first portion. A third flexible transparent sheet is superposed on the second portion and joined to the first sheet to form a pocket with the second portion. Means appendant an edge of the first portion contains apertures therein for cooperating with the page retaining means to retain the page in the binder, such that the second portion is not superposed on said means appendant when the second portion is folded upon the first portion. A fourth flexible transparent sheet may be superposed on the first portion and joined to the first sheet to form at least one additional pocket with the first portion.

BRIEF DESCRIPTION OF THE DRAWINGS

The novel features which are believed to be characteristic of the invention, together with further advantages thereof, will be better understood from the following description considered in connection with the accompanying drawings in which preferred embodiments of the invention are illustrated by way of example. It is to be expressly understood, however, that the drawings are for the purpose of illustration and description only and are not intended as a definition of the limits of the invention.

FIG. 1 is a perspective view of a preferred embodiment of the register according to the present invention;

FIG. 2 is a plan view of a preferred page according to the present invention;

FIG. 3 is a side sectional view of the page shown in FIG. 2 taken along the line 3—3 in the direction of the appended arrows;

FIG. 4 is a plan view of an alternative preferred page according to the present invention;

FIG. 5 is a side sectional view of the page shown in FIG. 4 taken along the line 5—5 in the direction of the appended arrows; and FIG. 6 is an edge view of an alternative preferred embodiment of the register, showing a second version of a binder with retained pages according to the present invention.

DESCRIPTION OF THE PREFERRED EMBODIMENTS

Turning first to FIG. 1, there is shown a loose-leaf binder 10 having a front cover 12 and a back cover 14 joined to a spine 16, the binder 10 being shown for clarity with its front cover 12 in a partially open position. Attached to the inside of the spine 16 is page retaining means, such as a clasp 18 including a plurality of openable and closeable rings 20 as is conventional in the loose leaf binder art.

The overall dimensions of the binder 10 are such that the binder 10 may be received within a bank safety deposit box of preferably a small standard size. Accordingly, the covers 12, 14 of the binder 10 are preferably rectangular and have long edges 22 and short edges 24 of dimensions smaller than the inside dimensions of a standard safety deposit box. For example, the long edges 22 may be at least approximately eleven inches in length (preferably approximately thirteen inches) and the short edges 24 approximately five inches or less (preferably approximately $4\frac{3}{4}$ inches), while the width of the spine 16 may be approximately one inch.

A page 26 according to the present invention is retained within the binder 10, and attention is directed to FIGS. 2 and 3 for a detailed description of the page 26.

The page 26, which is fabricated of a flexible material, includes a first panel 28 having at least one and preferably a plurality of transparent pockets 30 each for receiving a photograph such as a photographic slide transparency 32 or other illustrative documentation.

Similar to the binder covers 12, 14 (FIG. 1), the first panel 28 is preferably rectangular and includes first and second long edges 34, 36 and first and second short edges 38, 40.

A tab 42 having apertures 44 is appendant along the first short edge 38 of the first panel 28, for cooperating with the rings 20 (see FIG. 1) of the ring clasp 18 for retaining the first panel 28 in the binder 10. It may be appreciated that the first panel 28 may be considered to extend in its long dimension to include the apertures 44, in which case the first short edge of the panel 28 would be considered as being shown in FIG. 2 by the reference numeral 38'.

The page 26 further includes a second panel 46, being rectangular and having first and second long edges 48, 50 and first and second short edges 52, 54. The second panel 46 is hingedly attached along its first long edge 48, to the first panel 28 along its first long edge 34—to produce a longitudinal hinge 56 along a fold line 58 for permitting the second panel 46 to be folded upon the first panel 28 as shown in its normally folded position in FIG. 1. The fold line 58 is perpendicular to the first short edge 38 or 38' of the first panel 28.

The second panel 46 contains a transparent pocket 60 for receiving a written description of the photographs 32 arranged in the pockets 30 of the first panel 28, for example, an inventory log 62 which describes the items represented in each of the photographs 32. As shown in FIG. 2, the inventory log 62 is positioned in the pocket 60 such that when the page 26 is in its open or unfolded position, an observer may simultaneously view both the inventory log 62 and the photographs 32, as shown in FIG. 2. When the page 26 is not being used or viewed, the longitudinal hinge 56 permits the second panel 46 containing the inventory log 62 to be folded toward the observer along the fold line 58 and upon the first panel 28.

The first short edge 52 of the second panel 46 is situated—with respect to the apertures 44 along the first short edge 38 of the first panel 28—such that when the first panel 28 is retained by the binder 10 the second panel 46 is normally folded upon the first panel 28 without the first short edge 52 of the second panel 46 engaging or otherwise interfering with the rings 20 of the binder 10 (see FIG. 1). Further, when the front cover 12 is in a fully open position, the second panel 46 may be unfolded away from the first panel 28, and folded toward and upon the first panel 28, without interference between the short edge 52 of the second panel 46 and the rings 20 of the binder 10. Accordingly, the first short edge 52 of the second panel 46 is positioned with respect to the first short edge 38 or 38' of the first panel 28 such that the second panel 46 is not superposed upon the apertures 44 when folded, or at any time during folding or unfolding of the second panel 46 with respect to the first panel 28.

The dimensions of the page 26 are such that they may be assembled within the covers 12, 14 of the binder 10, which in turn has dimensions for being received within a standard bank safety deposit box. For example, when in its folded condition the page 26 may be approximately five inches or less (preferably $4\frac{1}{2}$ inches) along its short dimension and may be at least approximately eleven inches (preferably approximately $11\frac{3}{4}$ inches) along its long dimension.

An alternative embodiment of the page according to the present invention is shown in FIGS. 4 and 5, the only difference between the page 26' of FIG. 4 and the page 26 of FIG. 2 being the provision of the pockets 30' in the first panel 28 of FIG. 4 of a size and quantity for receiving photographic prints rather than the smaller photographic slide transparencies. Accordingly, for ease of description, the same reference numerals are used in FIGS. 4 and 5 to represent components which correspond to those shown in FIGS. 2 and 3. The following description concerning a manner of fabricating the page 26' is applicable as well to fabricating the page 26. The preferred embodiments of the page 26, 26' are fabricated of a flexible transparent thermo adhesive material such as clear vinyl or polyvinyl chloride, although a clear acetate film covering a non-slip backing material may be alternatively employed.

Referring to FIGS. 4 and 5, a first flexible transparent sheet 64 is folded to form the longitudinal hinge 56 along the fold line 58 parallel to the long edges 36, 50 of the first sheet 64, dividing the first sheet 64 into a first portion 66 extending from the hinge 56 to the edge 36, and a second portion 68 extending from the hinge 56 to the edge 50. The hinge 56 is implemented by procedures conventional in the materials fabrication art, and particularly with respect to thermo adhesive materials. The hinge 56 can be heat formed along the fold line 58; for example, by means of a 3/16 inch multicrease bar seal extending along the fold line 56.

A second flexible transparent sheet 70 is superposed on and joined to the first portion 66 of the first sheet 64, to form the pockets 30' of the page 26' (FIGS. 4 and 5), or to form one of the tiers of pockets 30 of the page 26 (FIGS. 2 and 3). This may be accomplished by heat sealing the second sheet 72 along its two short edges and one of its long edges, to the first portion 66 of the first sheet 64 along corresponding edges, to form joints or seams 72 along the edges 38', 38, 40, 36, with a fourth edge 74 of the second sheet 70 remaining unsealed to form the opening of the pockets 30'. Additional heat seals or seams 76 join the second sheet 70 to the first portion 66 of the first sheet 64, to further define the pockets 30'.

A third flexible transparent sheet 78 is superposed on the second portion 68 of the first sheet 64, and is heat sealed thereto along its edges corresponding to short edges 52, 54 and long edge 50, with the unsealed long edge 80 forming the pocket 60 for receiving the inventory log 62 shown in FIG. 2.

It can be appreciated that the second or upper tier of pockets 30 in the first panel 28 of the page 26 shown in FIGS. 2 and 3, is formed by means of a fourth flexible transparent sheet 82 superposed on and joined to the first portion 66 of the first sheet 64 in the same manner as previously described with respect to the second sheet 70, except that the sealed edge 84 of the fourth sheet 82 is not joined to the second long edge 36 of the panel 28 but instead is positioned above the unsealed edge 74 of the second sheet 70, approximately midway between that edge 36 and the hinge 56.

Another version of a loose-leaf binder 88 is shown in FIG. 6, and includes top and bottom covers 90, 92 each having an inwardly bent flap 94, 96 along an edge adapted for retaining the pages 26, 26'. As is generally known to the binder art, the flaps 94, 96 respectively include apertures 98, 100 arranged for being aligned with the page apertures 44 (FIG. 2), with a post 102 received by a front-cover flap aperture 98 and a corresponding back cover flap aperture 100 for retaining the pages 26, 26' in the binder 88. For this purpose, at least two posts 102 may be utilized in cooperation with a corresponding number of pairs of cover apertures 98, 100 and a corresponding number of page apertures 44. The posts 102 are removably received by the cover apertures 98, 100, for permitting the pages 26, 26' to be inserted into or removed from the binder 88; for example, each post 102 may include a head 104 at one end with its other end adapted for engaging a fastener, such as such other end being threadedly engageable with a nut 106.

The page retaining means of the binder 88 includes the flaps 94, 96 which extend slightly inwardly of the page apertures 44. The second panel 46 (of the page 26 or 26') is configured with respect to the first panel 28 such that the second panel's left edge 52 will clear the front cover flap 94 of the binder 88 (FIG. 6) when the front cover 90 is in an open condition. This can be assured either by providing the tab 42 with adequate depth to the right of the apertures 44 (as shown in FIG. 2), or by proportioning the longitudinal dimension of the second panel 46 to be smaller than the longitudinal dimension of the first panel 28 such that the second panel's left edge 52 is sufficiently to the right of the first panel's left edge 38, for permitting clearance when the second panel 46 is folded away from or toward the first panel 28.

Thus there has been described a register for the photographic documentation of property, including pages for containing photographs of items of property along with a description of such items. The register is particularly adapted for being maintained in a small standard bank safety deposit box. Other embodiments of the present invention, and other modifications and versions of the embodiments presented, may be developed without departing from the essential characteristics thereof. Accordingly, the invention should be limited only by the scope of the claims listed below.

We claim:

1. A register comprising in combination:

a binder having page retaining means;

at least one page for being retained in said binder, said page consisting of a first flexible panel having at least one transparent pocket, said first panel having means along an edge thereof for cooperating with said page retaining means for being retained in said binder, a second flexible panel having a transparent pocket, said second panel hingedly attached to said first panel along an edge of each of said panels, said edge of said first panel along which said second panel is hingedly attached being perpendicular to said edge of said first panel along which is situated said means for cooperating with said page retaining means, said second panel configured with respect to said first panel such that said second panel may be folded upon and unfolded away from said first panel along said hingedly attached edges without said second panel engaging said page retaining means when said page is retained in said binder.

2. The register according to claim 1, above, wherein said binder is a loose-leaf binder and said page retaining means include a plurality of rings which are openable and closeable, and said means along said edge of said first panel for cooperating with said page retaining means includes a plurality of apertures for receiving respective ones of said rings.

3. The register according to claim 1, above, wherein said binder includes a front cover and a rear cover, and said page retaining means includes a plurality of posts and means for detachably fastening said posts to said covers such that said covers may be opened and closed with respect to one another, and said means along said edge of said first panel for cooperating with said page retaining means of said binder includes a plurality of apertures for receiving respective ones of said posts.

4. The register according to claim 1, above, having dimensions for being accommodated within a safety deposit box when said page is retained within said binder with said second panel folded upon said first panel.

5. The register according to claim 1, above, wherein said binder has a front cover and a rear cover, said covers each being rectangular with long edges and short edges, and said page retaining means is secured to both of said covers along one of said short edges of each of said covers.

6. The register according to claim 5, above, wherein said short edges of each of said covers are each approximately five inches or less in length.

7. The register according to claim 6, above, wherein said long edges of each of said covers are at least approximately eleven inches in length.

8. The register according to claims 1, 2, 3, 4, 5, 6 or 7, above, wherein said pockets of said first panel are adapted for respectively receiving photographs, and said pocket of said second panel is adapted for receiving a description of the photographs received by said pockets of said first panel.

9. A page for being retained in a binder having page retaining means, comprising the combination of:

a first flexible panel having at least one transparent pocket and having means along an edge thereof for cooperating with the page retaining means for being retained in the binder; and a second flexible panel having a transparent pocket;

said first panel hingedly attached to said second panel along an edge of each of said panels, said edge of said first panel along which said second panel is hingedly attached being perpendicular to said edge of said first panel along which is situated said means for cooperating with the page retaining means, said second panel configured with respect to said first panel such that said second panel may be folded upon and unfolded away from said first panel along said hingedly attached edges without said second panel engaging the page retaining means when said page is retained in the binder.

10. The page according to claim 9, above, wherein said means for cooperating with the page retaining means includes a tab extending along said edge of said first panel and having apertures therein for receiving the page retaining means of the binder, such that said second panel is not superposed on said tab when said second panel is folded upon said first panel.

11. The page according to claim 9, above, having dimensions for being accommodated within a safety deposit box when said second panel is folded upon said first panel.

12. The page according to claim 9, above, wherein each of said panels is rectangular with long edges and short edges, said second panel is hingedly attached to said first panel along one of said long edges of each of said panels, and said means for cooperating with the page retaining means is situated along one of said short edges of said first panel.

13. The page according to claim 12, above, wherein said short edges of each of said panels are approximately five inches or less in length.

14. The page according to claim 13, above, wherein said long edges of each of said panels are at least approximately eleven inches in length.

15. The page according to claims 9, 10, 11, 12, 13 or 14, above, wherein said pockets of said first panel are adapted for respectively receiving photographs, and said pocket of said second panel is adapted for receiving a description of the photographs received by said pockets of said first panel.

16. A page for being retained in a binder having page retaining means, comprising:

a first flexible transparent sheet folded along a fold line parallel to an edge of said first sheet to form a first portion and a second portion hinged to one another along said fold line;

a second flexible transparent sheet superposed on said first portion and joined to said first sheet to form at least one pocket with said first portion;

a third flexible transparent sheet superposed on said second portion and joined to said first sheet to form a pocket with said second portion; and means along an edge of said first portion for cooperating with the page retaining means of the binder, for permitting said page to be retained by the binder with said second portion folded upon said first portion and such that said second portion may be unfolded away from said first portion without said second portion interfering with the page retaining means of the binder, said edge of said first portion being perpendicular to said fold line.

17. The page according to claim 16, above, further including a fourth flexible transparent sheet superposed on said first portion and joined to said first sheet to form at least one additional pocket with said first portion.

18. The page according to claim 16, above, wherein said sheets are of a thermo adhesive material and said first sheet is heat sealed along said fold line to form said first portion hinged to said second portion.

19. The page according to claim 16, above, having dimensions for being accommodated within a safety deposit box when said second portion is folded upon said first portion.

20. The page according to claim 16, above, wherein each of said portions is rectangular with long edges and short edges, said second portion is hinged to said first portion along one of said long edges of each of said portions, and said means for cooperating with the page retaining means is situated along one of said short edges of said first portion.

21. The page according to claim 20, above, wherein said short edges of each of said portions are approximately five inches or less in length.

22. The page according to claim 21, above, wherein said long edges of each of said portions are at least approximately eleven inches in length.

23. A page for being retained in a binder having page retaining means, comprising:

a first flexible transparent sheet folded along a fold line parallel to an edge of said first sheet to form a first portion and a second portion hinged to one another along said fold line;

a second flexible transparent sheet superposed on said first portion and joined to said first sheet to form at least one pocket with said first portion;

a third flexible transparent sheet superposed on said second portion and joined to said first sheet to form a pocket with said second portion; and means appendant an edge of said first portion for cooperating with the page retaining means to retain the page in the binder, such that said second portion is not superposed on said means appendant when said second portion is folded upon said first portion, said edge of said first portion being perpendicular to said fold line.

24. The page according to claim 23, above, further including a fourth flexible transparent sheet superposed on said first portion and joined to said first sheet to form at least one additional pocket with said first portion.

25. The page according to claim 23, above, wherein said sheets are of a thermo adhesive material and said first sheet is heat sealed along said fold line to form said first portion hinged to said second portion.

26. The page according to claim 23, above, wherein said means appendant includes a tab extending along said edge of said first portion and having apertures therein for receiving the page retaining means of the binder, such that said second portion is not superposed on said tab when said second portion is folded upon said first portion.

27. The page according to claim 23, above, having dimensions for being accommodated within a safety deposit box when said second portion is folded upon said first portion.

28. The page according to claim 23, above, wherein each of said portions is rectangular with long edges and short edges, said second portion is hinged to said first portion along one of said long edges of each of said panels, and said means appendant is situated along one of said short edges of said first portion.

29. The page according to claim 28, above, wherein said short edges of each of said portions are approximately five inches or less in length.

30. The page according to claim 29, above, wherein said long edges of each of said portions are at least approximately eleven inches in length.

31. The page according to claims 16, 17, 18, 19, 20, 21, 22, 23, 24, 25, 26, 27, 28, 29 or 30, above, wherein said pockets formed with said first portion are adapted for respectively receiving photographs, and said pocket formed with said second portion is adapted for receiving a description of the photographs received by said pockets formed with said first portion.

32. A register comprising in combination:

a binder having page retaining means;

at least one page for being retained in said binder, said page consisting of a first flexible rectangular panel having at least one transparent pocket, said first panel having means along an edge thereof for cooperating with said page retaining means for being retained in said binder, a second flexible rectangular panel having a transparent pocket, said second panel hingedly attached to said first panel along an edge of each of said panels, said edge of said first panel along which said second panel is hingedly attached being adjacent said edge of said first panel along which is situated said means for cooperating with said page retaining means, said second panel configured with respect to said first panel such that said second panel may be folded upon and unfolded away from said first panel along said hingedly attached edges without said second panel engaging said page retaining means when said page is retained in said binder.

33. A page for being retained in a binder having a page retaining means, comprising the combination of:

a first flexible rectangular panel having at least one transparent pocket and having means along an edge thereof for cooperating with the page retaining means for being retained in the binder; and a second flexible rectangular panel having a transparent pocket;

said first panel hingedly attached to said second panel along an edge of each of said panels, said edge of said first panel along which said second panel is hingedly attached being adjacent said edge of said first panel along which is situated said means for cooperating with the page retaining means, said second panel configured with respect to said first panel such that said second panel may be folded upon and unfolded away from said first panel along said hingedly attached edges without said second panel engaging the page retaining means when said page is retained in the binder.

* * * * *